United States Patent [19]

Walker

[11] 3,991,773

[45] Nov. 16, 1976

[54] OPTIONAL DRY OR LIQUID FILTER

[76] Inventor: Eric E. Walker, 1108 NE. 16th St., Fort Lauderdale, Fla. 33304

[22] Filed: Feb. 20, 1975

[21] Appl. No.: 551,429

Related U.S. Application Data

[62] Division of Ser. No. 324,123, Jan. 16, 1973, Pat. No. 3,884,246.

[52] U.S. Cl. ..... 131/264; 131/10.1

[51] Int. Cl.[2] ..... A24B 15/02

[58] Field of Search ..... 131/10.1, 10.5, 264, 131/265

[56] References Cited

UNITED STATES PATENTS

| | | | |
|---|---|---|---|
| 2,863,461 | 12/1958 | Frost, Jr. | 131/10.1 X |
| 3,390,686 | 7/1968 | Irby, Jr., et al. | 131/10.1 X |

FOREIGN PATENTS OR APPLICATIONS

| | | | |
|---|---|---|---|
| 1,077,127 | 3/1960 | Germany | 131/10.1 |
| 1,212,464 | 11/1970 | United Kingdom | 131/265 |

*Primary Examiner*—Robert W. Michell
*Assistant Examiner*—V. Millin
*Attorney, Agent, or Firm*—LeBlanc & Shur

[57] ABSTRACT

A dry or moist filter element for tobacco smoke is described. The filter comprises a resilient liquid-impervious tubular casing with a porous plug of filter material at either end thereof. A chamber is provided within the casing, between the plugs, defined by mutually spaced walls adjacent the inner end of each plug. Each end wall has at least one port therein to allow the passage of smoke therethrough. A liquid containing, frangible or collapsible module is disposed within the chamber. The module is shaped to permit the passage of smoke through the filter, and designed to admit the liquid contained therein, through the ports, into the plugs when the central portion of the casing is compressed. The filter element of this invention then may be used as a dry filter, or if desired, as a moistened or wet filter merely by compressing the casing to rupture or collapse the module. Preferred liquids which may be used in the module include aqueous solutions of starch, glucose, or salt in biologically acceptable concentrations, alcohol to prevent freezing, or an aqueous, buffered solution containing the enzyme amylase.

10 Claims, 12 Drawing Figures

FIG. 1
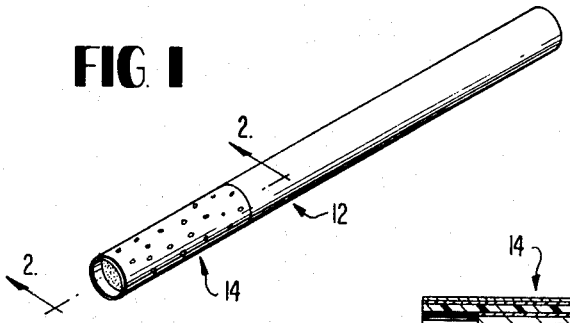
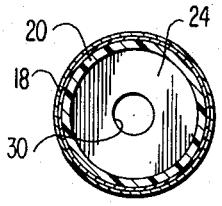
FIG. 6
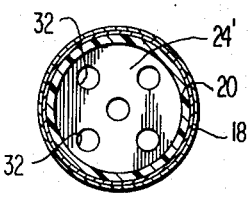
FIG. 7
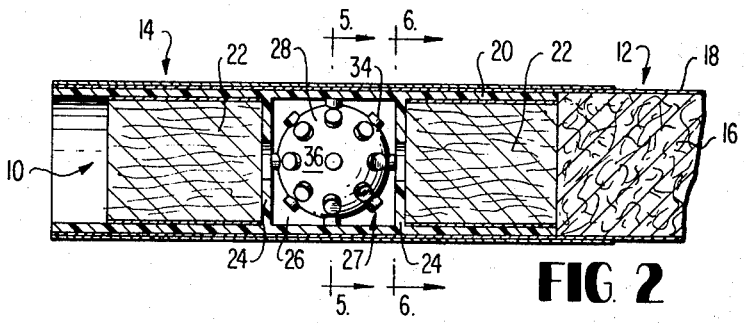
FIG. 2
FIG. 5
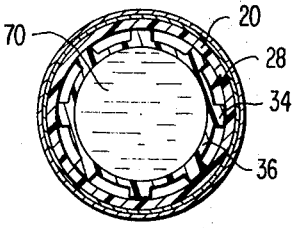
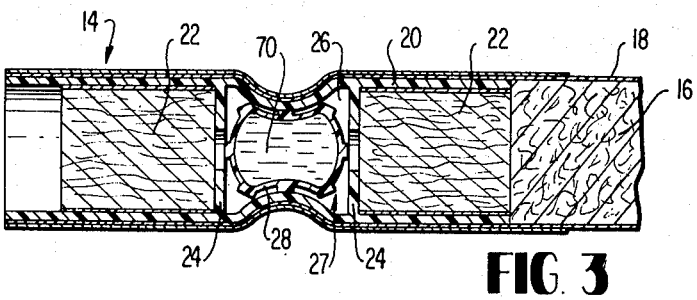
FIG. 3
FIG. 8
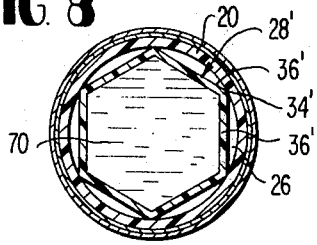
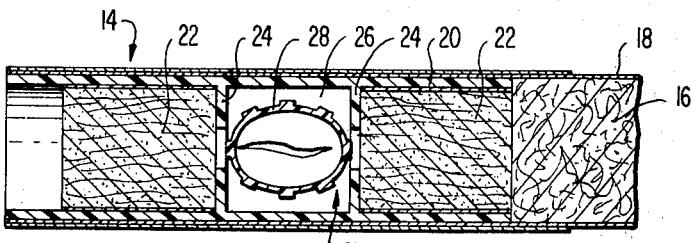
FIG. 4
FIG. 9
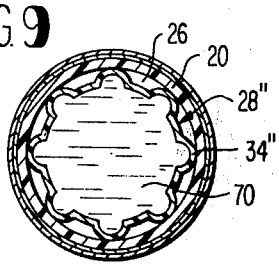
FIG. 10
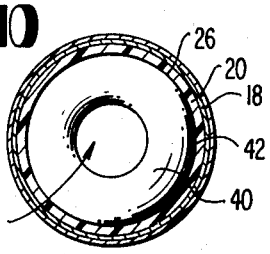
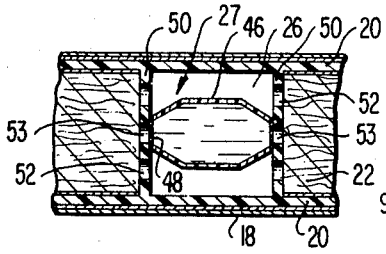
FIG. 11
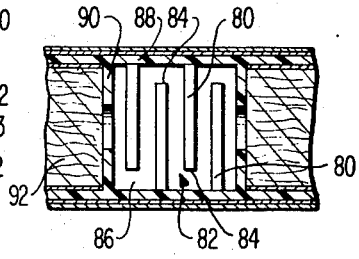
FIG. 12

OPTIONAL DRY OR LIQUID FILTER

This is a division of application Ser. No. 324,123, filed Jan. 16, 1973, now U.S. Pat. No. 3,884,246.

This invention relates to filter elements and particularly to an improved filter for tobacco smoke which may be used with cigarettes, cigars, or pipes. The filter of this invention is capable of functioning in the conventional manner as a dry filter, or if desired, as a moistened or liquid filter. The filter element of this invention contains, in a centrally located frangible or collapsible module, a liquid designed to saturate the porous filter media therein only when the casing is compressed whereby the improved properties of a moistened filter element are available only when desired by the smoker.

Many attempts to design efficient filter elements for tobacco smoke have been described in the prior art, and several of these elements contain means for moistening or humidifying a porous filter. Typically, a module containing water or an aqueous solution is embedded in the element, and the module is compressed to release the liquid before the filter is used. The moistened filter material in the element then exhibits an improved ability to remove primarily tars, nicotine, and certain other volatiles from the smoke. The liquids also may contain flavoring agents, if desired.

For example, in U.S. Pat. No. 3,428,049 to Leake et al one or more of such modules are surrounded by a compressed filter material in the element. When the module is compressed the liquid saturates the filter material causing it to expand and occupy the space within the element formally occupied by the module.

In U.S. Pat. No. 3,635,226 to Horsewell et al. a liquid-containing capsule is disposed between an absorbent plug, adjacent the tobacco, and a nonabsorbent plug. When the capsule is compressed the liquid is released into the absorbent plug. U.S. Pat. No. 3,596,665 to Lundegard also describes a frangible, liquid-containing module disposed between two plugs. Compression of this module releases the liquid into both plugs for enhanced filtering.

In addition, many different liquids have been used in moistened filters. Examples thereof are water, glycerin, and aqueous solutions or emulsions containing aromatic flavoring agents. These liquids act, in the filter, primarily to cool the smoke and to facilitate condensation of volatile components therein on the filter substrate.

However, the aforementioned prior filters lack the desired versatility necessary for widespread acceptance. In the prior filters the module must be ruptured before the filter will draw satisfactorily. In some instances smoke will not pass through the filter element until the module or the seals therefor are ruptured. In others, the filter medium is compacted and does not expand to allow the smoke to pass freely therethrough until moistened by the liquid.

In addition, when the filter is used out-of-doors under low ambient temperature conditions, the liquid contained therein may freeze. The module then will not rupture easily, and the smoker will be inconvenienced by having to thaw the cigarette before it may be smoked.

It should be noted that although it is highly desirable to remove a high percentage of volatiles from tobacco smoke before is is inhaled, these volatiles enhance the taste and enjoyment associated with smoking. Accordingly, removal of major portions of these components from the smoke has not been universally accepted even though medical evidence indicates that these components may be hazardous to the smoker's health. Furthermore, studies indicate that the last few puffs of a cigarette are more harmful than the first few, but no prior filter known is capable of increased filtration during the last puffs of a cigarette.

However, it has been discovered that a versatile filter may be provided which may be used as a dry filter in the well known manner, or as a moistened filter, if desired. The filter element of this invention then may be adapted for use both by smokers who desire maximum filtration with each cigarette smoked; smokers who desire maximum filtration with only some of the cigarettes smoked; and by those who desire maximum filtration with only the last few puffs of each cigarette.

The filter of this invention includes a cylindrical casing of a resilient, water impervious material having a plug of porous filter material at either end. A chamber is defined, within the casing by opposed, mutually spaced walls disposed adjacent the inner ends of the plugs. The walls, however, have ports provided therein to facilitate the passage of smoke through the filter element.

A liquid containing module having a preselected shape is disposed within the chamber. The walls of the module may be frangible or brittle, or if desired, the walls may be thin and flexible so that when the central portion of the casing is compressed the liquid will be expelled from the module into both plugs. If the central portion of the casing is not compressed the plugs will act as a conventional dry filter for tobacco smoke.

In addition, it has been discovered that improved filtration results when the liquid utilized is a biologically acceptable aqueous solution of for example, glucose; salt, as a saline solution; starch; or preferably, a solution of synthetic saliva extract. The synthetic saliva extract may be a buffered, slightly alkaline, aqueous solution containing from 0.5 to about 3 percent of the enzyme amylase, lysozyme, and a mild hemostatic agent, if desired. The liquid also may contain a high percentage of ethyl alcohol to prevent freezing, or any other biologically acceptable liquid useful to lower the freezing point of the liquid moistening agent.

Accordingly, it is an object of this invention to provide a versatile filter element for tobacco smoke which may be used as either a conventional dry filter or as a moistened filter, as desired.

It is another object to provide a filter element for tobacco smoke having a liquid containing module therein which will emit said liquid into said filter when the central portion thereof is compressed, but which will not substantially obstruct the flow of smoke through the filter.

It is another object to provide a freezing resistant liquid solution in a biologically acceptable concentration; said liquid encapsulated in a frangible module disposed in a chamber within a filter element for selectively moistening fibrous tobacco filter material disposed in either end thereof.

It is still another object to provide a tobacco smoke filter element having a water impervious casing, a porous plug of filter material at either end, and a frangible, liquid-containing module disposed therebetween, said module configured to define, with said casing, a passage for smoke therethrough, and adapted to emit said liquid into said material when compressed.

It is yet another object to provide a tobacco smoke filter element having a water impervious casing, porous plugs of filter material at either end thereof, mutually spaced end walls having ports therethrough and disposed adjacent the inner ends of said plugs; and a collapsible liquid-containing capsule affixed to said walls adjacent ports therethrough and disposed therebetween, so that when the central portion of said casing is compressed said capsule will collapse and emit the liquid through the ports in said walls, into the filter plugs to improve the ability of said element to filter smoke passing therethrough.

These and other objects will become readily apparent with reference to the drawings and following description wherein:

FIG. 1 is a perspective view of a cigarette having an embodiment of the filter element of this invention mounted thereon;

FIG. 2 is a cross sectional view taken along lines 2—2 of FIG. 1;

FIG. 3 is a fragmentary cross sectional view similar to FIG. 2 illustrating compression of the central portion of the element of this invention;

FIG. 4 is a fragmentary cross sectional view of the embodiment of FIGS. 2 and 3 after the central portion thereof has been compressed and liquid expelled into the filter material;

FIG. 5 is a cross sectional view taken along lines 5—5 of FIG. 2;

FIG. 6 is a cross sectional view taken along lines 6—6 of FIG. 2;

FIG. 7 is a cross sectional view similar to FIG. 6 illustrating a plurality of ports through an end wall in an embodiment of the filter element of this invention;

FIG. 8 is a cross sectional view similar to FIG. 5 showing an alternate embodiment of the module of this invention;

FIG. 9 is a cross sectional view similar to FIG. 5 showing another alternate embodiment of the module of this invention;

FIG. 10 is a cross sectional view similar to FIG. 5 showing yet another alternate embodiment of the module of this invention;

FIG. 11 is a fragmentary cross sectional view showing another alternative embodiment of the filter element of this invention; and FIG. 12 is a fragmentary cross sectional view similar to FIG. 5 showing another alternative embodiment of the filter element of this invention.

With reference to the drawings, and specifically with reference to FIGS. 1–4, the filter element of this invention 10 may be mounted, as shown in FIG. 1, on a conventional cigarette 12 in the mouthpiece 14 in the well known manner, or it may be utilized in a cigarette holder, a filter pipe, or on the end of a cigar (not shown). The filter element of this invention 10, however, is preferred for use with a cigarette 12 to provide an optional dry or liquid filter for smoke drawn therefrom. The element 10, may be recessed in mouthpiece 14 as shown in FIG. 1, or it may be mounted flush with the end of the mouthpiece in the conventional manner.

Cigarette 12 contains tobacco 16 wrapped in paper 18, and may be provided with a cork or other mouthpiece 14. The element 10 of this invention including a resilient, water impervious casing 20 is then preferably disposed within mouthpiece 14 abutting the tobacco 16.

A plug 22 of any conventional porous filter material is disposed at either end of casing 20. The filter material may be any well known type, and this invention is not intended to be limited to the particular type of filter material employed. Accordingly, the filter material may be a fibrous material, such as treated or untreated paper, but must be sufficiently porous to permit the passage of smoke therethrough.

Opposed, mutually spaced end walls 24 are disposed within casing 20 adjacent the inner ends of plugs 22. End walls 24 together with the internal surface 26 of the central portion of casing 20 form a chamber 27 within element 10.

A liquid containing module 28 is disposed within chamber 27. At least a portion of the external surface thereof contacts surface 26 of casing 20 and preferably end walls 24.

As shown in FIGS. 6 and 7 end walls 24 may have a single, centrally disposed port 30 therethrough, or a plurality of mutually spaced ports 32 to allow the passage of smoke therethrough, and to permit liquid from module 28 to flow from chamber 27 into plugs 22. End walls 24 may be constructed of any suitable materials such as polyethylene or polypropylene.

The module 28 may have a variety of different shapes within the scope of this invention to facilitate the passage of smoke through element 10. With attention to FIG. 5, module 28 may have the general configuration a sphere, with a plurality of mutually spaced protrubances 34 affixed to the external surface of the sphere 36. The diameter of sphere 36 should be less than the diameter of casing 20. However, the distal portions of some of protrubances 34 should contact the internal surface 26 of casing 20. In this way smoke may pass around protrubances 34 and through chamber 27, and, as shown in FIG. 3, only a slight external depression of the central portion of casing 20 will rupture module 28.

In addition, the distal portion of a plurality of protrubances 34 may contact end walls 24, as shown in FIG. 2, if desired.

As will be obvious to those skilled in the art, the thin walled module 28 may be constructed of any frangible water impervious materials such as a brittle plastic, or a gelatine. Module 28 preferably contains from 1–2 c.c. liquid.

Accordingly, as shown in FIG. 3, when the central portion of casing 20 is compressed with, for example 2–5 pounds pressure, the frangible module 28 will rupture and the liquid will be expelled into chamber 27. The liquid will then pass through ports 30 and 32 into end plugs 22 as shown in FIGS. 4, 6 and 7, saturating plugs 22.

As shown in FIGS. 8, 9 and 10 the liquid containing module need not be spehrical, but, as shown in FIG. 8, the module 28′ may have the cross sectional configuration of a polygon. The edges 34′ of module 28′ where the external surfaces 36′ intersect should contact the internal surface 26 of casing 20. In addition, as shown in FIG. 9, the module 28″ may have protrubances 34″ which are hollow and liquid containing, and which contact the inner surface 26 of casing 20.

With reference to FIG. 10, another embodiment of the module of this invention may have a toroidal shape 40 wherein the external surface 42 contacts the internal surface 26 of casing 20, and a passageway 44 is provided through the center thereof. Alternate embodiments (not shown) may include a spiral or helical hollow module wherein the external surface or a portion thereof contacts the internal surface of the resilient casing.

The liquid containing module of this invention, however, must provide at least one passageway for smoke. In the embodiments of FIGS. 5, 8, and 9, the passage is provided around the external surface between the protrubances 34 or 34'' or edges 34' of the module 28' shown in FIG. 8. The passage may also be provided through the center of the module in the case of the toroid 40 shown in FIG. 10.

In this way, smoke from cigarette 12 will normally pass through plugs 22, ports 30 or 32 in end walls 24 and through chamber 27, if the smoker desired to utilize the filter element of this invention as a dry filter. However, in the event it is desired to utilize the filter of this invention as a liquid filter, the central portion of mouthpiece 14 is compressed as shown in FIG. 3 and module 28 expels the liquid contained therein into the filter plugs 22 whereby the plugs become saturated with the liquid for improved filtration.

With attention to FIG. 11, in the embodiments of this invention described in FIGS. 1–10, the liquid containing module is disposed in chamber 18 with portions of the exterior abutting the internal surface 26 of casing 20 and preferably, walls 24 so that when the casing is compressed the brittle or frangible module will rupture. However, it is not essential to provide a module constructed of brittle material. As shown in FIG. 11, the module may be a flexible sack 46 having weakened ends 48 of, for example, gelatin, affixed to the end walls 50. Walls 50 may be provided with a plurality of ports 52, as desired. In addition, if desired, a centrally disposed port 53 may be provided in end walls 50. Port 53 may be surrounded in sealing engagement or plugged by the end portions 48 of module 46. Module 46 then preferably has a lateral diameter less than the diameter of casing 20 and extends longitudinally between the end walls 50. Accordingly, when the central portion of casing 20 is compressed, ends 48 will rupture expelling liquid through the end portions 48 and centrally located ports 53 into plugs 22.

As will be obvious to those skilled in the art, in the embodiment of FIG. 11, end walls 50 may be removed and fibrous filter material used to surround and support module 46 within chamber 27. The module 46 containing from ½ to 1 cc of fluid could be manufactured as an endless belt for mass production. The liquid module is embedded in the fibrous filter with clearance enough on each side for free passage, in this manner allowing a more reasonable manufacturing cost.

Finally, as shown in FIG. 12, a plurality of liquid containing modules 80 may be provided within chamber 82. Modules 80 could be shaped as segments of a circular dish having a rupturable port at the flattened end portions 84. Or, if desired, modules 80 may be shaped like tentacles extending from the internal surface 86 of casing 88. In this way smoke entering chamber 82 could be circulated around and through the modules before passing through end wall 90 and filter substrate 92.

Although a variety of different types of liquids 70 may be contained within the module of this invention, it is preferred to utilize a sterile, biologically acceptable solution simulating the natural body fluid saliva. Saliva typically is an aqueous solution. containing from 0.5 to 3.0 percent of the enzyme amylase, the enzyme lysozyme, and a mild hemostatic agent. The hemostatic agent may be any well known, pharmaceutically acceptable compound present in this embodiment of the liquid of this invention in trace quantities. It has been found that the filter of this invention saturated with either sterile human saliva or a synthetic saliva solution containing one or more of the aforementioned enzymes, is capable of removing up to about 80 percent of the tars and nicotine in the smoke from regular or king size cigarettes, and slightly less than 80 percent from the smoke of longer cigarettes.

In the alternative, the liquid 70 may be water, or a biologically acceptable aqueous solution of, for example, glucose; salt, as a saline solution; or starch as a thin corn starch syrup. Typically the solute for the solution of this invention is present in a concentration of no more than about 5 percent by weight.

Also, in the preferred embodiment of this invention a biologically acceptable agent is added to the liquid 70 to prevent the freezing thereof. A preferred agent is ethyl alcohol which may be present in up to 50 parts per 100, by weight, in the liquid 70 in order to prevent freezing thereof at temperatures down to approximately 50° below freezing. Accordingly, it is preferred to include ethyl alcohol in the liquid 70 contained in the filter 10 of this invention in a quantity effective to prevent freezing thereof under ambient temperature conditions.

In summary, the optional dry or liquid filter of this invention comprises a resilient water impervious casing having plugs of filter material disposed at either end thereof. End walls having ports therethrough are disposed within the casing, adjacent the inner ends of said plugs, to define, with the central portion of said casing, a chammber. A liquid containing module is disposed in the chamber.

The module is configured to permit passage of smoke through the chamber without substantial obstruction so that when the cigarette is smoked, smoke may pass through the plugs, through the ports in the end walls and through the chamber, and the tobacco may be smoked in the conventional manner with only dry filtration provided by the plugs. In the alternative, the central portion of the casing may be compressed to expel the liquid from the module contained therein into the plugs to provide a moistened, highly efficient filter for tobacco smoke.

Therefore, the device of this invention may be utilized optionally, with, for example, every other cigarette smoked; with each cigarette smoked; or with each cigarette after smoking a portion thereof. Therefore, the smoker will utilize the improved filtering qualities provided by a moistened filter according to this invention when desired, and a filter universally adaptable to a wide variety of different smoking tastes is provided.

Finally, the liquid containing module of this invention, in one embodiment thereof, is disposed within the chamber with at least a portion of the external surface thereof abutting both the inner surface of the casing, and the inner surfaces of the end walls. In this embodiment the module preferably is constructed of brittle or frangible material.

In an alternate embodiment the module may be a flexible sack affixed centrally to the inner surfaces of the end walls. In this embodiment the smoke will be permitted to pass through ports in the end walls and around the liquid containing module. However, when the central portion of the casing is compressed the liquid will be expelled in the aforementioned manner through ports in the end walls to saturate the filter materials.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed and desired to be secured by United States Letters Patent is:

1. A tobacco smoke filter element comprising:

a resilient water impervious elongated tubular casing having a porous plug of filter material disposed at each end of said casing;

opposed mutually spaced disc-like walls disposed within said casing between said plugs, one wall abutting the inner surface of each plug, said walls defining a chamber within the central portion of said casing and having at least one port in each wall;

at least one liquid containing module formed of brittle, water impervious material, disposed within said chamber and extending between said walls, said module configured to define with the ports in said walls at least one passage for smoke through said filter element;

means carried by said element and cooperating between said module and at least one port in each of said walls for directing liquid from said module through the ports into said plugs responsive to compression of the external walls of said chamber so that said plugs may act selectively as a dry filter or, when said casing is compressed, as a filter moistened by said liquid.

2. The device of claim 1 wherein each of said walls has a coaxial port opening therethrough.

3. The device of claim 1 wherein each of said walls has a plurality of mutually spaced ports opening therethrough, said ports equidistantly spaced around the central axis thereof.

4. The device of claim 1 wherein said module is spherical with a plurality of radial protrusions spaced around the external surface thereof, the distal portions of a plurality of said protrusions abutting the internal wall of the central portion of said casing.

5. The module of claim 4 wherein the interior of each of said protrusions is hollow and in communication with the interior of said module.

6. The module of claim 4 wherein said protrusions are integrally formed on the external surface of said spherical module.

7. The module of claim 4 wherein the distal portions of at least one of said protrusions abuts the inner surface of each of said walls.

8. The device of claim 1 wherein the external surface of the module describes a polygon in cross sectional configuration with a portion of the external surface thereof abutting the internal surface of a central portion of said casing.

9. The module of claim 8 wherein a portion of the external surface thereof abuts the internal surface of each of said walls.

10. The device of claim 1 wherein said module is a toroid with the outer surface thereof abutting a portion of the inner surface of the central portion of said casing.

* * * * *